US006165027A

United States Patent [19]

Huang et al.

[11] Patent Number: 6,165,027

[45] Date of Patent: Dec. 26, 2000

[54] ELECTRICAL CONNECTOR

[75] Inventors: Chieh-Jung Huang, Tao-Yuan; Ming-Lun Szu, Taipei, both of Taiwan

[73] Assignee: Hon Hai Precision Ind. Co., Ltd., Taipei Hsien, Taiwan

[21] Appl. No.: 09/414,297

[22] Filed: Oct. 6, 1999

[30] Foreign Application Priority Data

Apr. 27, 1999 [TW] Taiwan ..... 88206561

[51] Int. Cl.[7] ..... H01R 13/41

[52] U.S. Cl. ..... 439/752.5; 439/733.1

[58] Field of Search ..... 439/752.5, 733.1, 439/342

[56] References Cited

U.S. PATENT DOCUMENTS

| | | | |
|---|---|---|---|
| 3,980,385 | 9/1976 | Hirokawa et al. | 439/752.5 |
| 5,195,913 | 3/1993 | Shattuck | 439/752.5 |
| 5,350,292 | 9/1994 | Sanders et al. | 439/752.5 |
| 5,425,661 | 6/1995 | Self, Jr. et al. | 439/752.5 |
| 5,658,173 | 8/1997 | Genta | 439/752.5 |

*Primary Examiner*—Gary F. Paumen
*Attorney, Agent, or Firm*—Wei Te Chung

[57] ABSTRACT

An electrical connector adapted for connecting with a chip comprises a housing and a number of contacts. The housing defines a number of cavities therein. Each cavity is formed with a pair of ribs extending from an inner surface of the cavity along an insertion direction of the contacts. Each contact is received in the corresponding cavity of the housing and abuts against the positioning device for preventing deflection thereof.

1 Claim, 5 Drawing Sheets

ELECTRICAL CONNECTOR

BACKGROUND OF THE INVENTION

1. Field of the Invention

The present invention relates to an electrical connector, and particularly to an electrical connector having a positioning device for preventing contacts thereof from deflecting.

2. Dekscription of Prior Art

A conventional electrical connector generally includes a housing and a plurality of contacts received in the housing, such as the disclosures of Taiwan Patent Application Nos. 84109322 and 85205279. The contacts engage with corresponding contacts of a mating connector. Thus, to ensure high quality signal transmission, the contacts should be securely arranged in the housing.

Referring to FIGS. 1A, 1B and 1C, a conventional electrical connector 100 includes a housing 102 forming a plurality of slots 104 therein, and a plurality of contacts 106 forming barbs 108 on opposite lateral edges thereof for interferentially engaging with peripheries of the corresponding slots 104. A width d of each slot 104 is larger than a thickness h of each contact 106 to prevent friction therebetween and for facilitating assembly of the contacts 106 to the housing 102. However, since the slot 104 is larger than the contact 106, when the electrical connector 100 is connected with a mating connector, a mating force may cause the contacts 106 to deflect in the slots 104. Thus, the quality of signal transmission is reduced.

SUMMARY OF THE INVENTION

Accordingly, an object of the present invention is to provide an electrical connector having a positioning device formed in a housing thereof for preventing contacts thereof from deflecting.

In the preferred embodiment of the present invention, an electrical connector adapted for connecting with a chip comprises a housing and a plurality of contacts. The housing defines a plurality of cavities therein. Each cavity is formed with a positioning device. Each contact is received in the corresponding cavity of the housing and abuts against the positioning device for preventing deflection thereof.

BRIEF DESCRIPTION OF THE DRAWINGS

Other objects and advantages of the present invention will be understood from the following description of an electrical connector according to a preferred embodiment of the present invention shown in the accompanying drawings, in which.

DETAILED DESCRIPTION OF THE PREFERRED EMBODIMENT

Figure 1A:
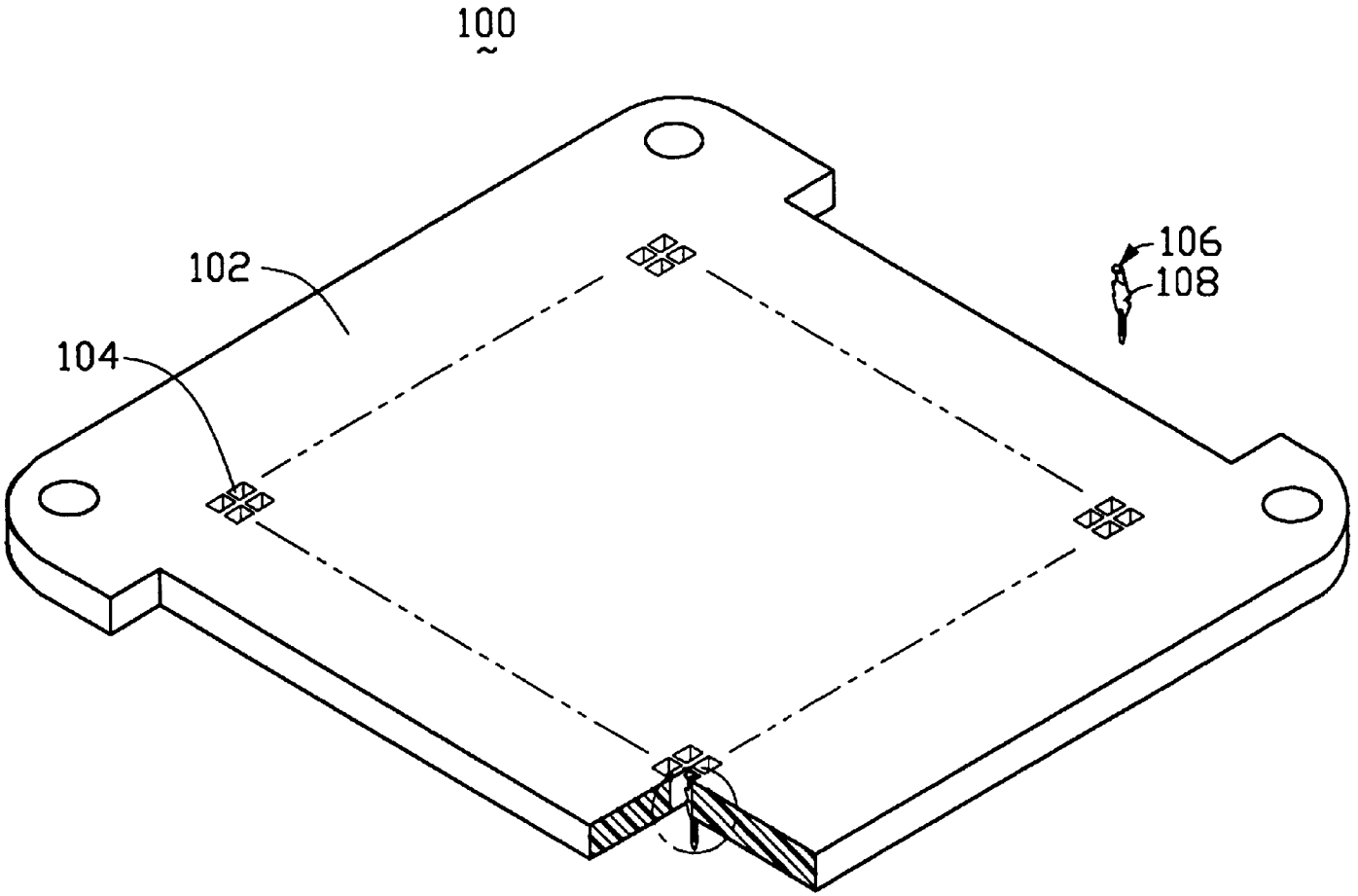
FIG. 1A (PRIOR ART)
FIG. 1A is a perspective view of a conventional electrical connector with a contact removed therefrom.
Figure 1C:
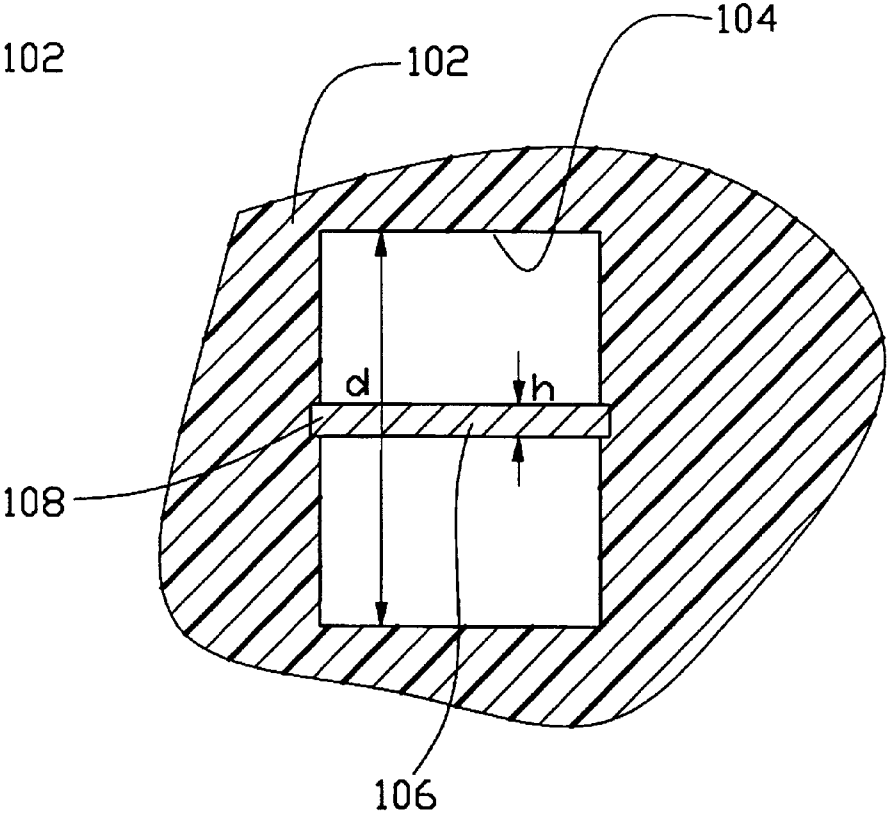
FIG. 1C (PRIOR ART)
FIG. 1C is a partial cross-sectional view taken along line 1C—1C of FIG. 1B.
Figure 1B:
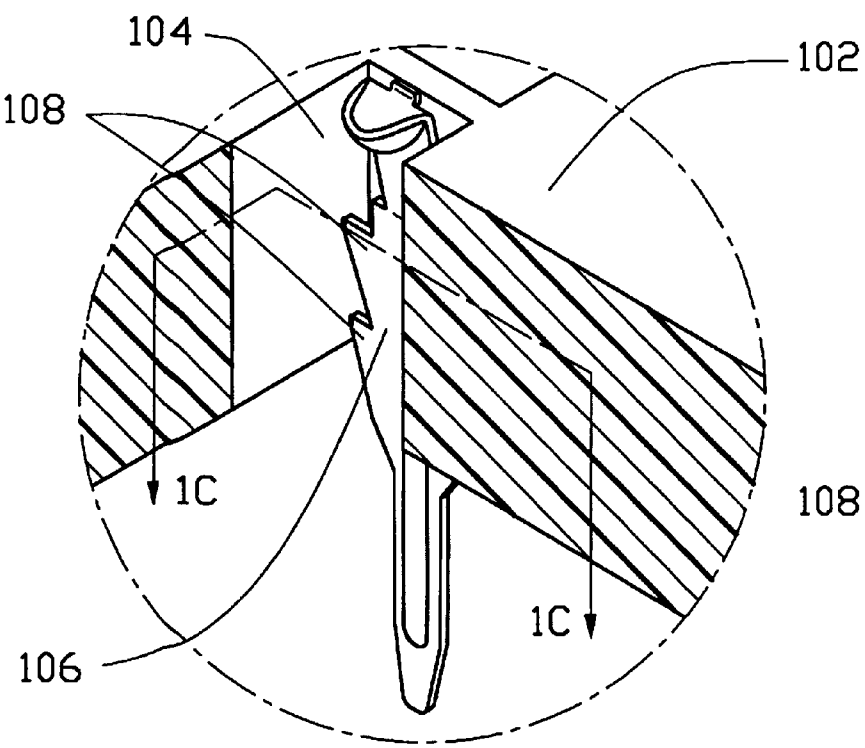
FIG. 1B (PRIOR ART)
FIG. 1B is an enlarged fragmentary perspective view of FIG. 1A.
Figure 2:
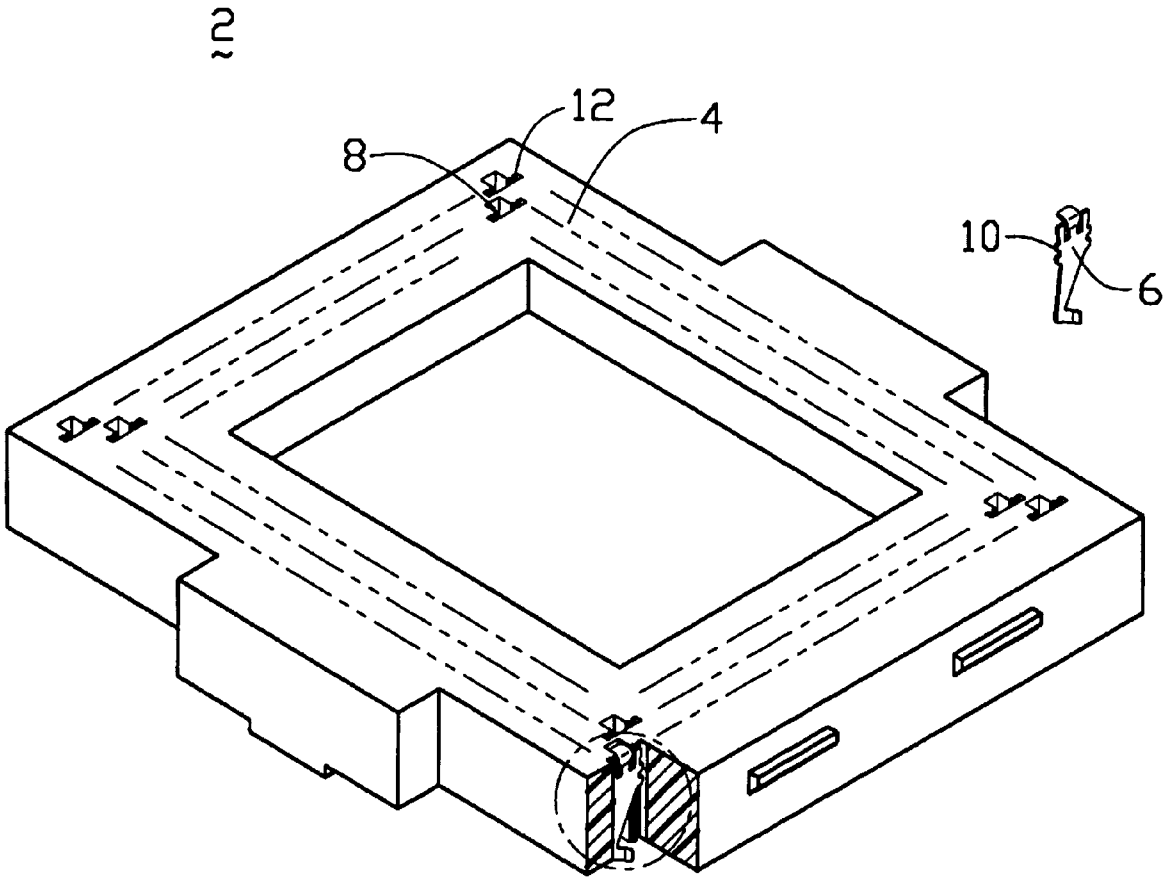
FIG. 2 is a bottom view of an electrical connector embodying the concepts of the present invention with a contact removed therefrom.
Figure 4:
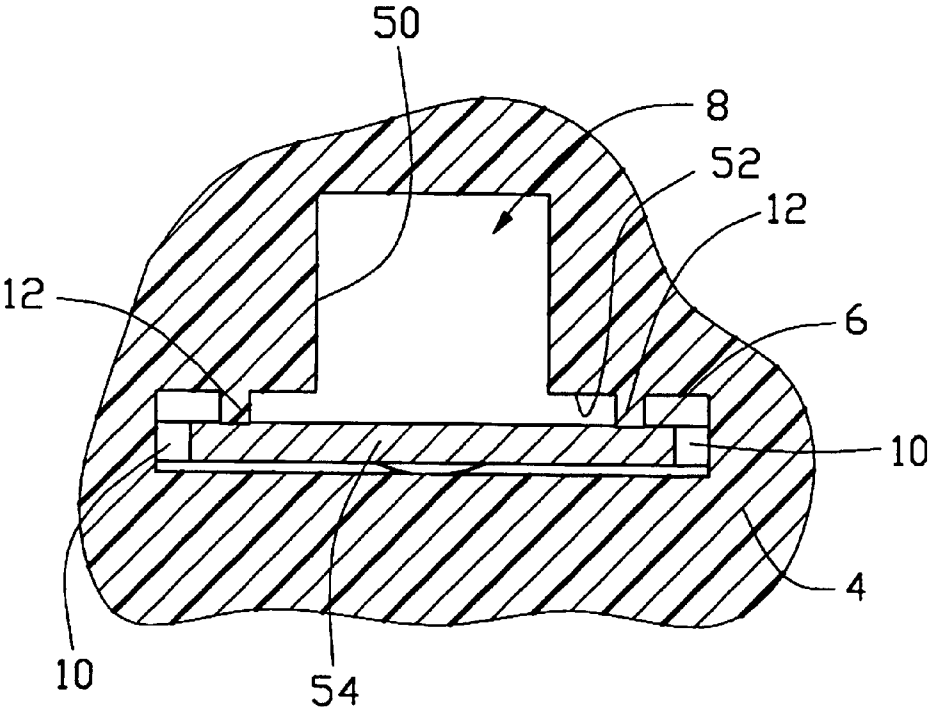
FIG. 4 is a partial cross-sectional view taken along line 4—4 of FIG. 3.
Figure 3:
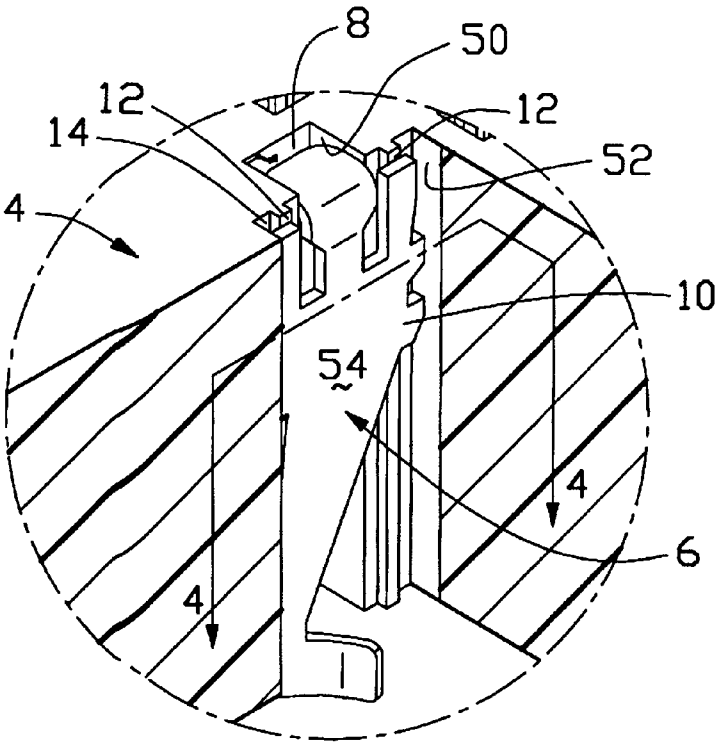
FIG. 3 is an enlarged fragmentary bottom perspective view of FIG. 2.
Figure 5:
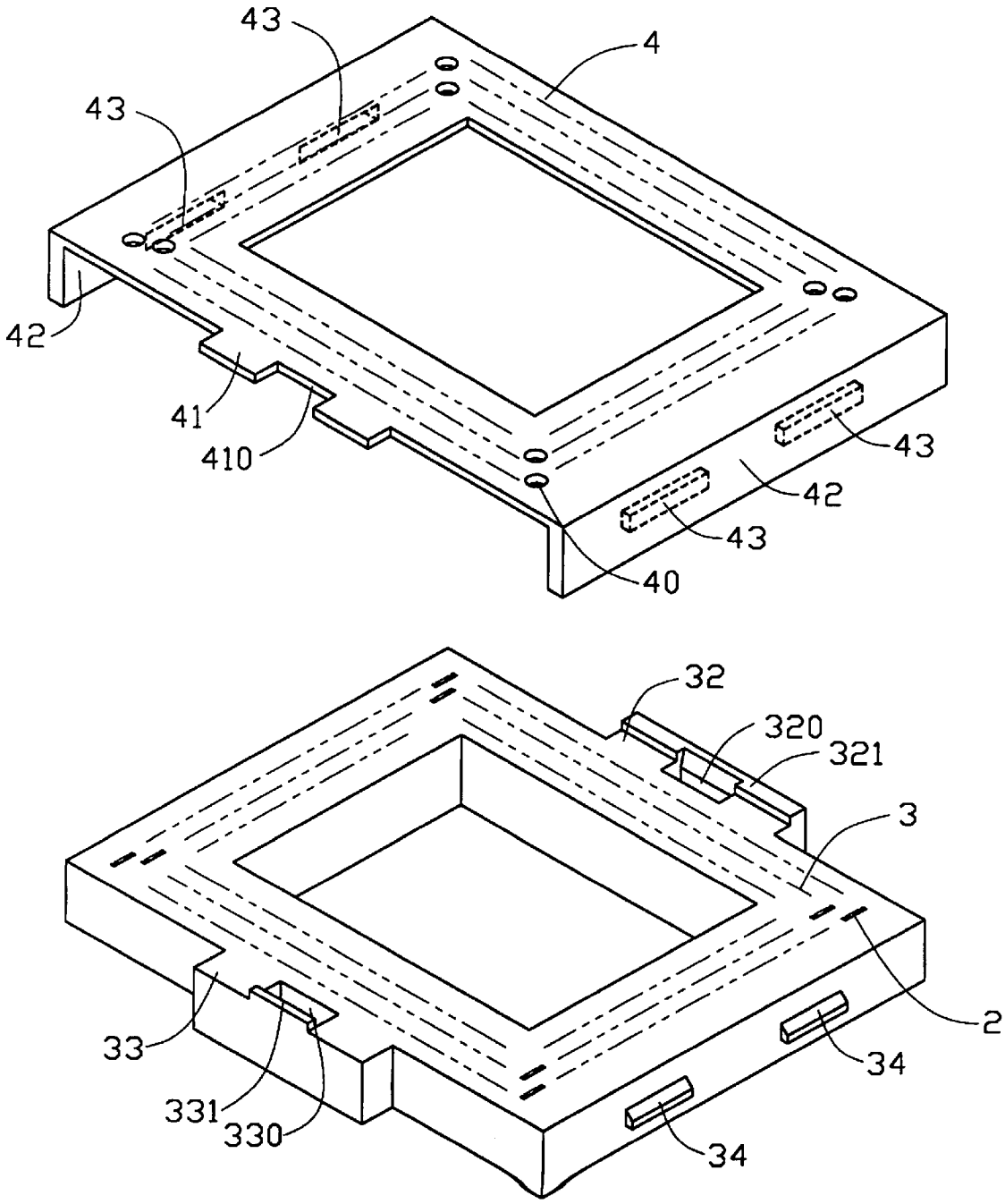
FIG. 5 is an exploded view of an electrical connector of the present invention.

Referring to FIGS. 2–5, an electrical connector 2 in accordance with the present invention includes a housing 4 and a plurality of contacts 6 received in the housing 4. The housing 4 forms a plurality of cavities 8 for receiving the contacts 6. Each cavity 8 generally includes a relatively large space 50 and a relatively small space 52 in communication with each other. Each contact 6 includes a plate body 54 with barbs 10 formed on opposite lateral edges thereof for interferentially engaging peripheries of the relatively small space 52 of the corresponding cavity 8 of the housing 4.

The cavities 8 are T-shaped. Each cavity 8 includes a positioning device for preventing the contact 6 from deflecting during an assembly procedure or when a mating force is exerted thereon. The positioning device comprises a pair of ribs 12 extending from an inner surface 14 of the relatively small space 52 of the cavity 8 along an insertion direction of the contacts 6 in this embodiment. Alternatively, the positioning device may be a plurality of protrusions or the like extending from an inner surface 14 of the cavity 8 along an insertion direction of the contacts 6.

In assembly, each contact 6 is interferentially received in the corresponding cavity 8 and abuts against the ribs 12. When the electrical connector 2 is connected with a mating connector, the contacts 6 do not sway or deflect in the cavities 8 due to the protrusion of the ribs 12.

It will be understood that the present invention may be embodied in other specific forms without departing from the spirit of the central characteristics thereof. The present examples and embodiments, therefore, are to be considered in all respects as illustrative and not restrictive, and the invention is not to be limited to the details given herein.

What is claimed is:

1. An electrical connector adapted for connecting with a chip, comprising:

a housing defining a plurality of T-shaped cavities each comprising a relatively larger space and a relative small space; and a plurality of contacts respectively received within the corresponding cavities, each of said contacts defining a plate body with barbs on two opposite edges thereof and interferentially engaged within the small space of said corresponding cavity; wherein a pair of rib integrally formed with the housing and extend into the small space of each of said cavities in a direction perpendicular to said plate body each said pair of ribs forcing the respective contact against a wall of the respective cavity.

* * * * *